US006461466B1

(12) United States Patent
Cho

(10) Patent No.: US 6,461,466 B1
(45) Date of Patent: Oct. 8, 2002

(54) TRANSCRIBING METHOD OF STEERING WHEEL RIM OF AUTOMOBILE USING WATER PRESSURE

(76) Inventor: Youn-soo Cho, 504-201 Hyojachon, 301 Seohyun-dong, Bundang-gu, Sungnam-city, Kyungki-do (KR)

( * ) Notice: Subject to any disclaimer, the term of this patent is extended or adjusted under 35 U.S.C. 154(b) by 0 days.

(21) Appl. No.: 09/538,900

(22) Filed: Mar. 30, 2000

(30) Foreign Application Priority Data

Apr. 2, 1999 (KR) ..... 99-11606

(51) Int. Cl.[7] ..... B44C 1/175; B41M 3/12; B05D 5/06; B05D 1/20; B05C 3/20

(52) U.S. Cl. ..... 156/230; 156/236; 156/240; 156/285; 427/149; 427/267; 427/271; 427/272; 427/436.1; 427/434.3; 118/402; 118/403

(58) Field of Search ..... 156/230, 236, 156/239, 240, 241, 247, 277, 289, 285; 427/146, 147, 141, 434.3, 434.2, 256, 258, 262, 264, 267, 271, 272, 430.1; 118/402, 403

(56) References Cited

U.S. PATENT DOCUMENTS 4,010,057 A * 3/1977 Nakanishi ..... 156/384
6,022,438 A * 2/2000 Watanabe et al. ..... 156/230
6,124,154 A1 * 4/2001 Cho ..... 156/285

FOREIGN PATENT DOCUMENTS

| | | | | |
|---|---|---|---|---|
| EP | 0 839 672 A | | 5/1998 | |
| EP | 1 060 902 E | | 12/2000 | |
| EP | 1 088 676 E | | 4/2001 | |
| JP | 11-059093 A | | 3/1999 | |
| JP | 11-124042 | * | 5/1999 | ..... B62D/1/04 |
| JP | 2000-211530 | * | 8/2000 | ..... B44C/1/165 |
| JP | 2001-96993 | * | 4/2001 | ..... B41F/16/00 |

* cited by examiner

*Primary Examiner*—Jerry A. Lorengo
(74) *Attorney, Agent, or Firm*—Leydig, Voit & Mayer, Ltd.

(57) ABSTRACT

In a transcribing method for making a steering wheel rim of an automobile using water pressure and a printed transcribing sheet having a different pattern or brightness at the left and right sides, two symmetrical printed transcribing sheets are prepared using computer graphics for fitting to the steering wheel rim. In a first transcribing step, a first sheet is transcribed using a masking method. The surface where the first transcribing is performed is cleaned and masked, and the steering wheel rim is rotated by 180°. In a second transcribing step, on the surface of the steering wheel where no transcribing has been performed, a second printed transcribing sheet is transcribed to the steering wheel rim.

4 Claims, 8 Drawing Sheets

TRANSCRIBING METHOD OF STEERING WHEEL RIM OF AUTOMOBILE USING WATER PRESSURE

BACKGROUND OF THE INVENTION

1. Field of the Invention

The present invention relates to a transcribing method for making a steering wheel rim of an automobile using a printed transcribing sheet, and more particularly, to a transcribing method for making a steering wheel rim of an automobile using water pressure for effective transcribing when a pattern or brightness is quite different at each of the left and right sides of a printed transcribing sheet.

2. Description of the Related Art

Technologies related to a method of transcribing a pattern on a luxury steering wheel rim using a printed transcribing sheet have been disclosed in Korean Patent Application Nos. 98-17424, 98-17425, 98-36990, 98-36991 and 99-3368 filed by the present applicant.

First, an invention disclosed in Korean Patent Application No. 98-17424 solve problems, such as expansion and deformation of a printed pattern and mismatch of a printed state, of a conventional transcribing method using water pressure in which a transcribing film having a pattern is floated on water and the pattern is transcribed by pressing an object from above on which the pattern is transcribed. Here, selective transcribing on a part of or the entire surface is possible by using a mask member such as a masking tape or a rubber jig. Thus, according to the above transcribing method using water pressure, a high degree of matching is maintained with respect to an object such as a ball or round ring which is difficult to transcribe and a plurality of patterns or shapes can be realized on the object.

Also, in Korean Patent Application Nos. 98-17425, 98-36990 and 98-36991, various methods for enabling mass production by applying the transcribing method using water pressure of Korean Patent Application No. 98-17424 to a steering wheel of an automobile, are described.

The invention disclosed in Korean Patent Application No. 99-3368 achieves a faster and more accurate matching of a pattern by improving the procedural difficulty requiring accuracy with respect to a boundary portion at which a mask member is attached. In the above application, a process of maintaining the angle of the end portion of the masking tape at 60° and a technology facilitating accurate masking, while maintaining the masking tape separated at a distance of 0.1–0.2 mm from the central line after sequential transcribing is disclosed.

FIGS. 1 through 5 show a steering wheel of an automobile and a transcribing method using water pressure for making a steering wheel rim as one example of prior art by the present applicant of the present invention.

Referring to FIG. 1, portions a and b of a steering wheel rim other than a portion 1 coated with leather are coated in a transcribing method using water pressure. The portions a and b corresponding to the arc of the steering wheel rim are subjected to the transcribing method using water pressure.

When a printed transcribing sheet 2 having a symmetrical pattern to the left and right sides, as shown in FIG. 2, is transcribed on the portion a, the result thereof is shown as FIG. 3. As FIG. 3 is merely for the convenience of explanation, the curvature of the steering wheel rim shown therein may not be the same as that of the steering wheel rim shown FIG. 1, which is applied to the following drawings.

Next, the circular rod of FIG. 3 is turned 180° and the other half side is subjected to transcribing.

FIG. 5 shows an example of designing and transcribing a printed transcribing sheet 12 in the form shown in FIG. 4 befitting to the shape of the circular rod so that a pattern shown in FIG. 3 is smoothly formed. Various, aesthetic and natural patterns can be represented through the above process.

However, when a desired pattern having an asymmetrical pattern and directivity is used, that is, a printed transcribing sheet having a different pattern or opposing brightness at portions c and d of FIG. 3 is used, due to the difference in brightness of a pattern during the second transcribing after the first transcribing is completed, the transcribed pattern is not smooth and there is a considerable difference in brightness, so that the aesthetic appearance is poor and the pattern does not appear to be natural.

Also, when transcribing is performed for a desired particular portion of an incorporated type steering wheel rim having a boss portion protruding toward one side thereof, as shown in FIG. 1, the front side of the steering wheel rim having no boss portion is easy to transcribe. However, when transcribing is performed for the rear side of the steering wheel rim having the boss portion, a printed transcribing sheet is pressed by the boss portion, causing defective transcribing. Due to the above structural limit, multi-staged and local transcribing must be performed for the rear side of the steering wheel rim so that the boss portion does not press the printed transcribing sheet,

SUMMARY OF THE INVENTION

To solve the above problems, it is an objective of the present invention to provide a transcribing method for making a steering wheel rim of an automobile using water pressure so that a natural and aesthetic pattern or brightness is possible and defective transcribing due to the difference in brightness at the left and right sides or the representation of an asymmetrical pattern can be prevented.

Also, it is another objective of the present invention to provide a transcribing method of a steering wheel rim of an automobile which minimizes the number of steps for transcribing with respect to an object which is difficult to transcribe so that productivity can be improved.

Accordingly, to achieve the above objective, there is provided a transcribing method of a steering wheel rim of an automobile using water pressure using a printed transcribing sheet having a different pattern or brightness at the left and right sides thereof, the method comprising the steps of preparing two symmetrical printed transcribing sheets using computer graphics fitting to the steering wheel rim, performing a first transcribing on the steering wheel rim in a masking method, cleaning and masking the surface where the first transcribing is performed, rotating the steering wheel rim by 180° and performing a second transcribing on the surface where no transcribing is performed using another printed transcribing sheet having a symmetrical pattern or brightness.

It is preferred in the present invention that, on the printed transcribing sheet used for the first transcribing, fan shaped patterns are symmetrically designed at all corresponding positions on the printed transcribing sheet so that simultaneous transcribing is possible for each transcribing position at the front side of the steering wheel rim core.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
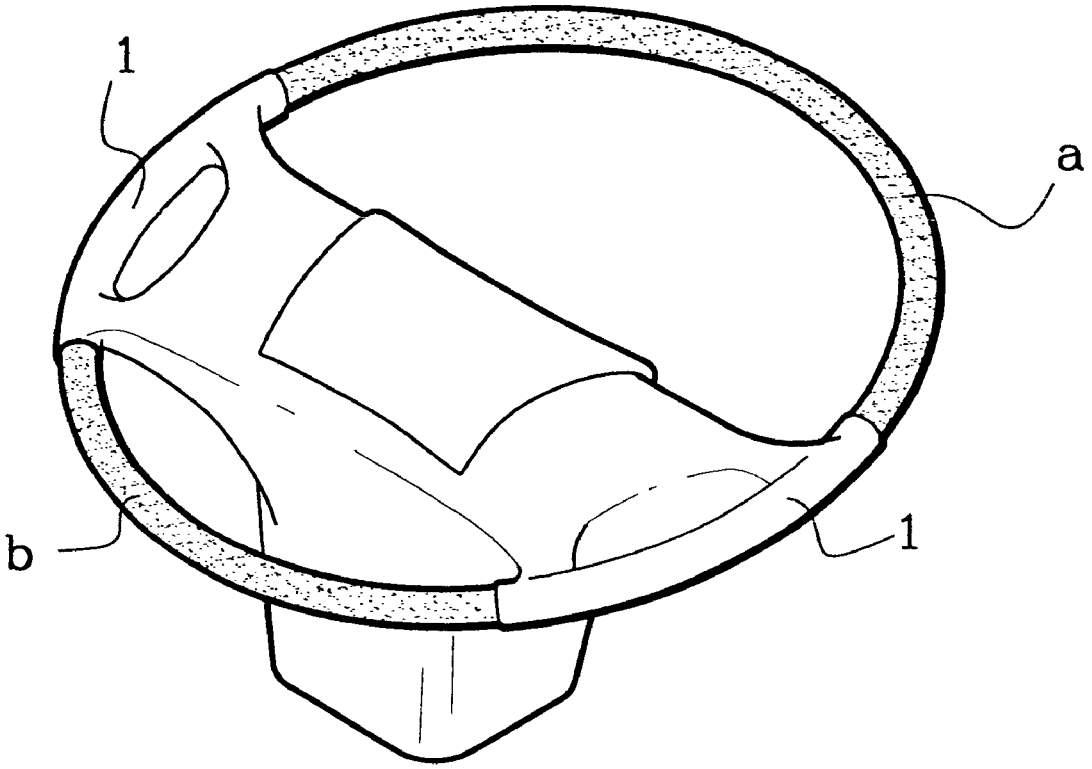
FIG. 1 (PRIOR ART)
FIG. 1 is a perspective view showing a typical steering wheel.
Figure 2:
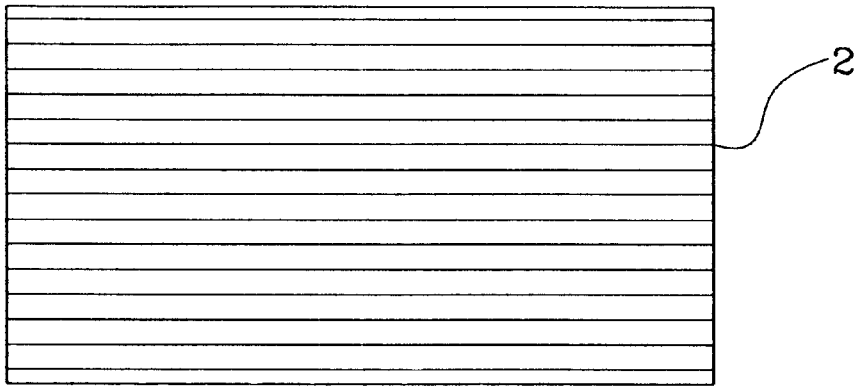
FIG. 2 (PRIOR ART)
FIG. 2 is a view showing an example of a printed transcribing sheet used for transcribing portions a and b of FIG. 1.
Figure 3:
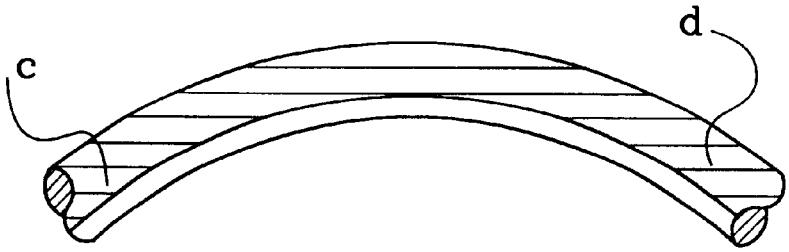
FIG. 3 (PRIOR ART)
FIG. 3 is a view showing a steering wheel rim on which the printed transcribing sheet of FIG. 2 is transcribed using water pressure.
Figure 4:
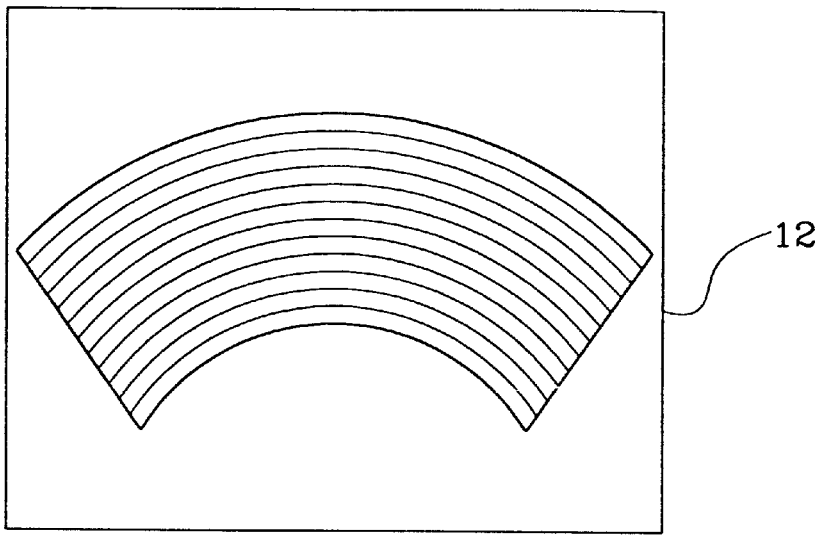
FIG. 4 (PRIOR ART)
FIG. 4 is a view showing another example of the printed transcribing sheet of FIG. 2.
Figure 5:
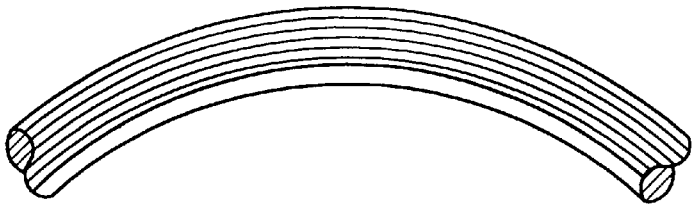
FIG. 5 (PRIOR ART)
FIG. 5 is a view showing a part of a steering wheel rim on which the printed transcribing sheet of FIG. 4 is transcribed using water pressure.
Figure 6:
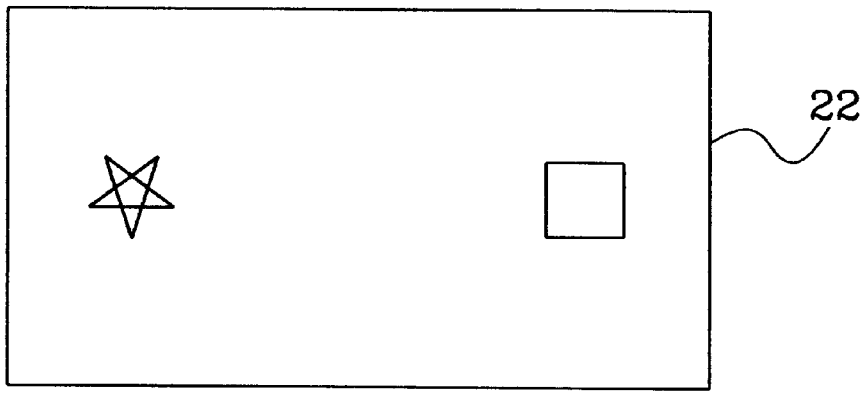
FIG. 6 is a view showing an example of a pattern of a printed transcribing sheet according to the present invention.
Figure 7:
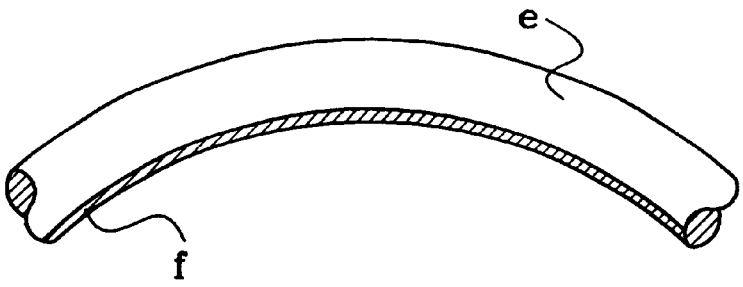
FIG. 7 is a view for explaining a printed transcribing sheet being transcribed using water pressure on a part of a steering wheel rim according to the present invention.

FIG. 6 shows an example of a printed transcribing sheet 22 for the convenience of explanation. In the printed transcribing sheet 22, a star shaped pattern and a square shaped pattern are formed at the left and right sides thereof, respectively, and the brightnesses at the left and right sides thereof are quite different. In this case, a portion e shown in FIG. 7 is masked and transcribing is performed on the other half portion f (the front side of the steering wheel rim). As a result, a star shaped pattern and a square shaped pattern are transcribed on the left side and the right side of the portion f, respectively, on the drawing sheet of FIG. 7. (FIG. 7 shows only the portion a of a steering wheel rim shown in FIG. 1 for the convenience of explanation, which will be applied to the following drawings.)

Next, after a cleaning process, the transcribed portion f is masked and the steering wheel rim is rotated by 180°. Then, a second transcribing is performed on the other half portion e (the rear side of the steering wheel rim) using the printed transcribing sheet 22 of FIG. 6. As a result, a square shaped pattern and a star shaped pattern are shown at the left and right sides thereof, respectively, on the drawing sheet of FIG. 7. Here, mismatch of patterns or a clear difference in upper and lower surface of both end portions, so that the pattern can be very unnatural.

Figure 8:
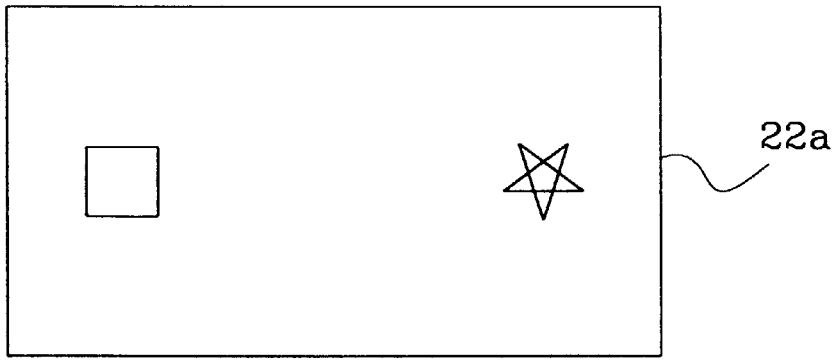
FIG. 8 is a view showing a printed transcribing sheet which is symmetrical compared to that of FIG. 6.

In light of the above, as shown in FIG. 8, when an additional printed transcribing sheet 22*a* on which a pattern is formed reversely and transcribing is performed using the printed transcribing sheets 22 and 22*a* in the same manner, the star shaped patterns are formed on the upper and lower surfaces of the same end portion while the square shaped patterns are formed on the upper and lower surfaces of the same opposing end portion. Thus, a natural and smooth combination of patterns can be maintained and products having a natural and smooth pattern without a difference in brightness at the left and right sides can be obtained.

Figure 9A:
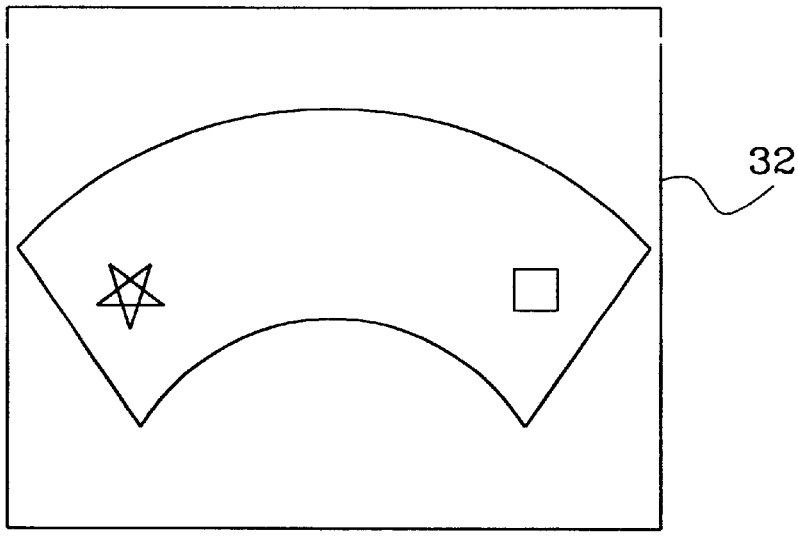
FIGS. 9A and 9B show a pair of arc shaped printed transcribing sheets which are symmetrical.
Figure 9B:
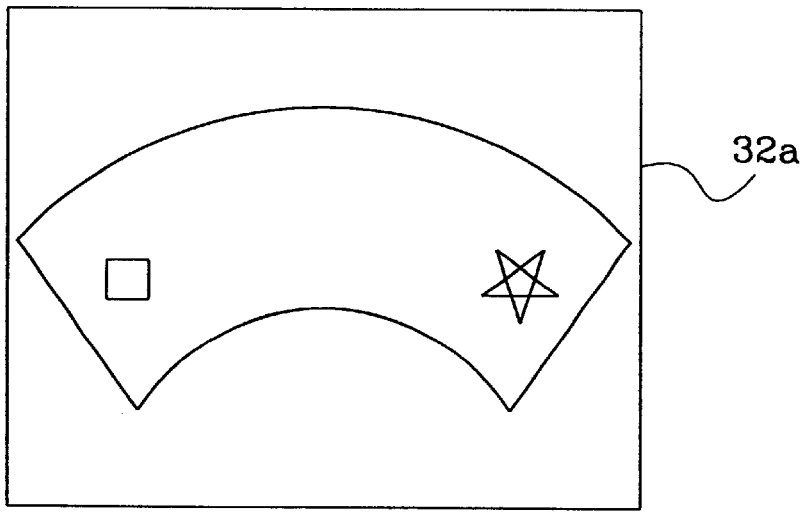

Preferably, as shown in FIGS. 9A and 9B, printed transcribing sheets 32 and 32*a* having a symmetrical pattern of a fan shape designed using computer graphics suitable for the shape of the circular rod are used.

Figure 10:
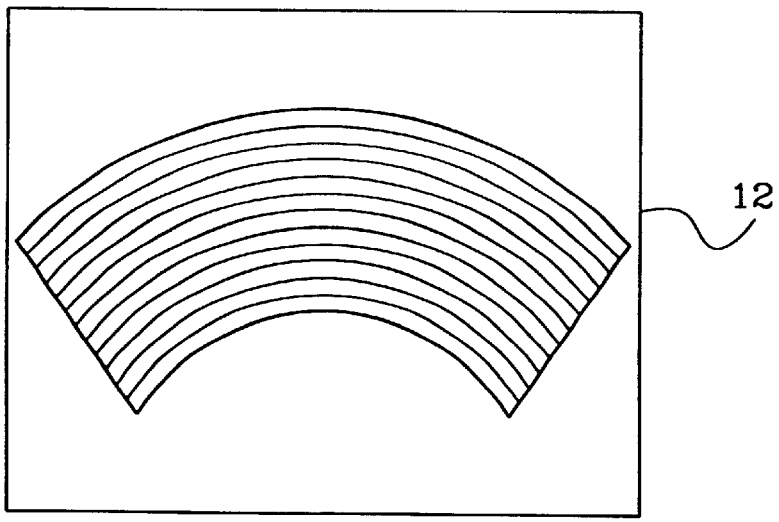
FIG. 10 is a view showing another example of the printed transcribing sheet according to the present invention.

FIG. 10 shows a printed transcribing sheet 12 formed according to another preferred embodiment of the present invention.

Figure 11A:
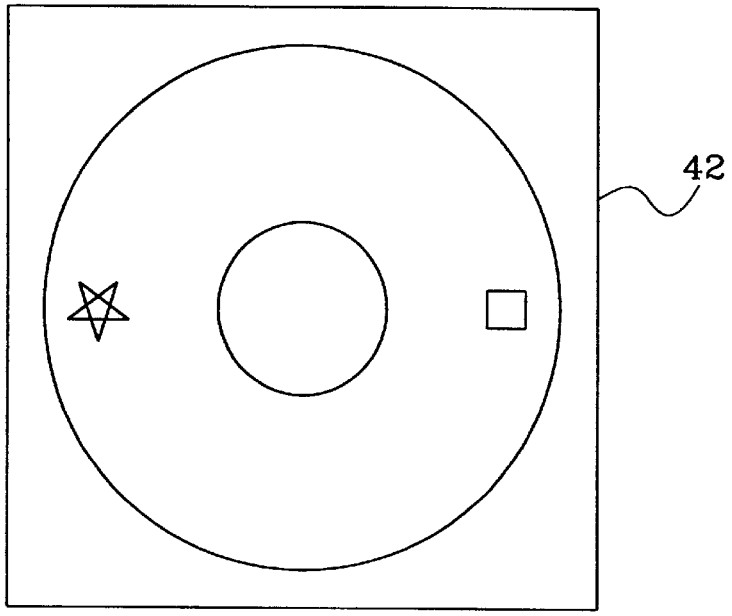
FIGS. 11A and 11B are views showing a pair of circular shaped printed transcribing sheets which are symmetrical.
Figure 11B:
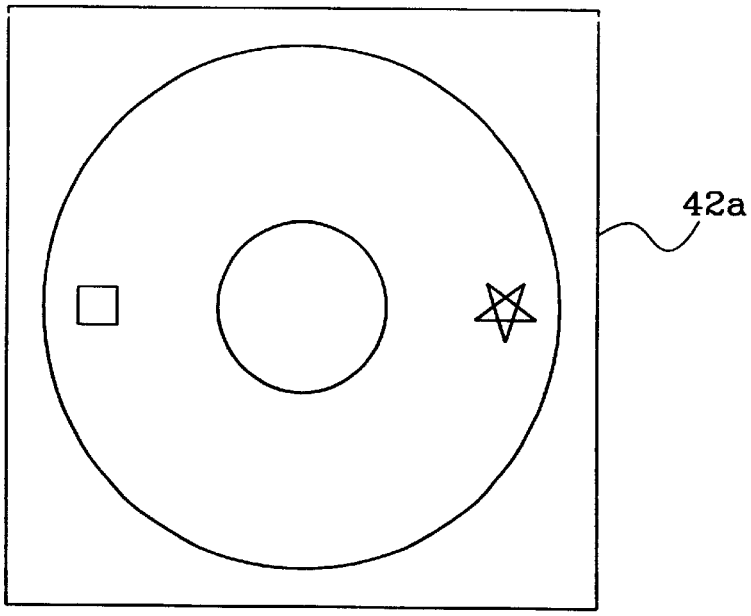

FIGS. 11A and 11B show a pattern having a disc shape. This pattern is used when first and second transcribing are performed on the entire steering wheel rim, not on a part thereof, such as portions a and b of FIG. 1. In the drawings, one example of a pair of printed transcribing sheets 42 and 42*a* having symmetrical patterns is shown.

Figure 12:
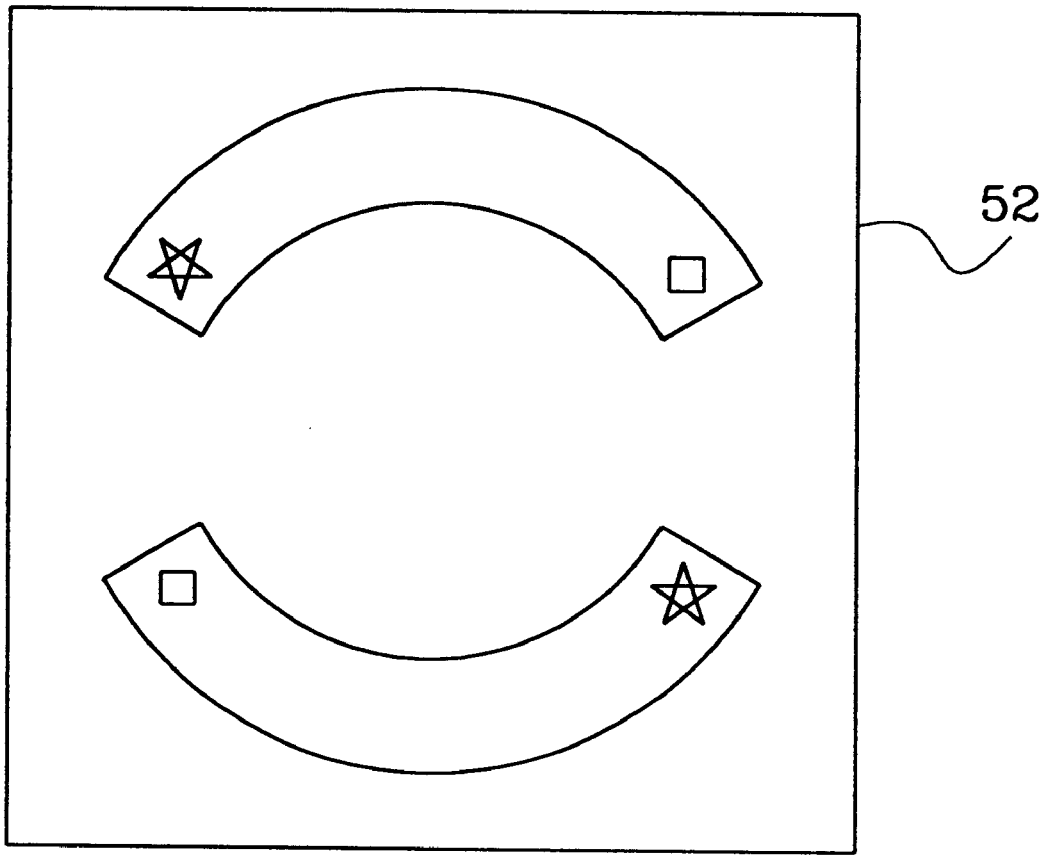
FIG. 12 is a view showing an example of a first printed transcribing sheet designed to enable simultaneous transcribing for all transcribing portions at the front side of the steering wheel rim during the first transcribing.

In addition to the above configuration of a pattern in a printed transcribing pattern, during the first process for transcribing of the front side of the steering wheel rim, as shown in FIG. 12, when the patterns of the first printed transcribing sheet 52 are symmetrically arranged with each position of all portions of the steering wheel rim subject to transcribing, the transcribing of the front side of the steering wheel rim is possible with only one transcribing process so that the process can be simplified.

That is, according to the transcribing method using water pressure, fan shaped patterns are symmetrically designed at all corresponding positions on the printed transcribing sheet 52 so that simultaneous transcribing is possible for each of the transcribing positions at the front side of a steering wheel rim core using the printed transcribing sheet 52. Thus, transcribing for corresponding portions at the front side of the steering wheel rim can be completed with one time transcribing process. The subsequent processes are performed in the same manner as described above.

As the transcribing process for the front side of the steering wheel rim can be completed through only one process, the process is simplified and the amount of work required can be reduced, thus improving productivity.

As described above, in a transcribing method of a steering wheel rim of an automobile using a printed transcribing sheet according to the present invention, when patterns at the left and right sides of the steering wheel rim are asymmetrical and the brightnesses are quite different at the left and right sides thereof and the pattern has a directivity, a printed transcribing sheet having a symmetrical pattern is prepared and first and second transcribing steps are performed using the printed transcribing sheet. Thus, a feeling of discontinuation due to mismatch of the pattern or a clear difference of brightness is removed and an aesthetic steering wheel rim can be manufactured. Also, various patterns can be freely represented according to the transcribing method of the present invention using water pressure.

What is claimed is:

1. A transcribing method for making a steering wheel rim of an automobile using water pressure and two printed transcribing sheets, each sheet having one of a different pattern and brightness at left and right sides of the sheet, the method comprising:

preparing first and second symmetrical printed transcribing sheets, using computer graphics, for fitting to a steering wheel rim;

in a first transcribing step, transcribing the first sheet onto a first part of a surface of the steering wheel rim after masking a second part of the surface of the steering wheel rim;

cleaning and masking the first part of the surface of the steering wheel rim where the first transcribing step has been performed;

rotating the steering wheel rim by 180°; and in a second transcribing step, transcribing the second sheet onto the second part of the surface of the steering wheel rim where no transcribing has been performed.

2. The method as claimed in claim 1, wherein the first and second printed transcribing sheets are each fan shaped, fitting the first and second parts of the steering wheel rim, respectively.

3. The method as claimed in claim 2, wherein patterns on the first and second printed transcribing sheets are symmetrical with each other.

4. The method as claimed in claim 1, wherein, the first printed transcribing sheet includes fan shaped patterns symmetrically located at all corresponding positions on the second printed transcribing sheet so that simultaneous transcribing is possible for each transcribing position at a front side of the steering wheel rim.

* * * * *